US006089728A

United States Patent [19]

Weinstein

[11] Patent Number: 6,089,728

[45] Date of Patent: Jul. 18, 2000

[54] NOVELTY POCKET FLASHLIGHT

[76] Inventor: Marc Chase Weinstein, 30 E. 95th St., #5F, New York, N.Y. 10128

[21] Appl. No.: 09/262,270

[22] Filed: Mar. 4, 1999

[51] Int. Cl.[7] ..... F21L 4/02

[52] U.S. Cl. ..... 362/116; 362/186; 362/200; 362/812; 40/555

[58] Field of Search ..... 362/116, 186, 362/189, 200, 201, 202, 208, 812, 361; 40/555

[56] References Cited

U.S. PATENT DOCUMENTS

| | | | |
|---|---|---|---|
| 1,360,575 | 11/1920 | Pinto | 40/555 |
| 1,834,805 | 12/1931 | Roddis | 362/116 |
| 2,166,864 | 7/1939 | Gelardin | 40/555 |
| 3,114,143 | 12/1963 | Robinson | 362/186 |
| 4,819,140 | 4/1989 | Griffin | 362/189 |
| 5,001,455 | 3/1991 | Starchevich | 40/555 |
| 5,463,539 | 10/1995 | Vandenbelt et al. | 362/189 |
| 5,642,931 | 7/1997 | Gappelberg | 362/186 |

*Primary Examiner*—Alan Cariaso
*Attorney, Agent, or Firm*—Myron Amer P.C.

[57] ABSTRACT

A pocket-sized battery-operated flashlight adapted for use as an advertising premium which is typically used in close range to illuminate a keyhole of a lock to open the lock with a key, for which close range use only a portion of straight-away light is needed, so that available excess light is diverted radially to illuminate a display to thereby contribute to the value of the flashlight as a premium.

2 Claims, 1 Drawing Sheet

NOVELTY POCKET FLASHLIGHT

The present invention relates to improvements for a pocketsize flashlight of a type illustrated and described in U.S. Pat. No. 4,819,140 for "Compressible Flashlight" issued to James P. Griffin on Apr. 4, 1989, wherein the improvements contribute to the novelty value of the flashlight operating mode to such a significant extent that the flashlight is an article of manufacture of choice for advertising purposes, all as will be better understood as the description proceeds.

EXAMPLES OF THE PRIOR ART

It is already well known by common experience that the advertising of trademark-identified products generate the sales thereof warranting large advertising expenditures, particularly for print media, T.V. commercials, and the like. Less expensive by comparison, but nevertheless cost effective, is the practice of distributing trademark-identified products known in advertising parlance as "premiums," often provided without cost by direct mail and at trade shows. Some trademark-identified products, such as caps and T-shirts, are even sold at full cost and are of the nature of being a premium because of their engendered trademark recognition in the public.

The noted '140 flashlight, by pocket or purse size and ease of use, has the desirable attributes for use as an advertising premium. However, if the trademark is embodied on the flashlight by being imprinted thereon, as exemplified by the indicia and/or text imprinted on the "Advertising Novelty" of U.S. Pat. No. 2,166,864 of Albert Gelardin issued on Jul. 18, 1939, and imprinted on the "Disposable Flashlight" of U.S. Pat. No. 4,939,626 of Matthaus Hoberstein issued on Jul. 3, 1990, the resulting product lacks the novelty value advertisers desire in a giveaway premium. The aforesaid and all other known comparable patented products do not use to advantage the battery-generated illumination to enhance the commercial display of the product.

Broadly, it is an object of the present invention to overcome the foregoing and other shortcomings of the prior art.

More particularly, it is an object to apportion from the total illumination of the within inventive premium flashlight a selected amount for straight ahead transmission in locating keyholes or the like, and a selected amount for radial transmission in backlighting a visual display, all to end of achieving both utilitarian and novelty uses for the flashlight.

The description of the invention which follows, together with the accompanying drawings should not be construed as limiting the invention to the example shown and described, because those skilled in the art to which this invention appertains will be able to devise other forms thereof within the ambit the appended claims.

Figure 1:
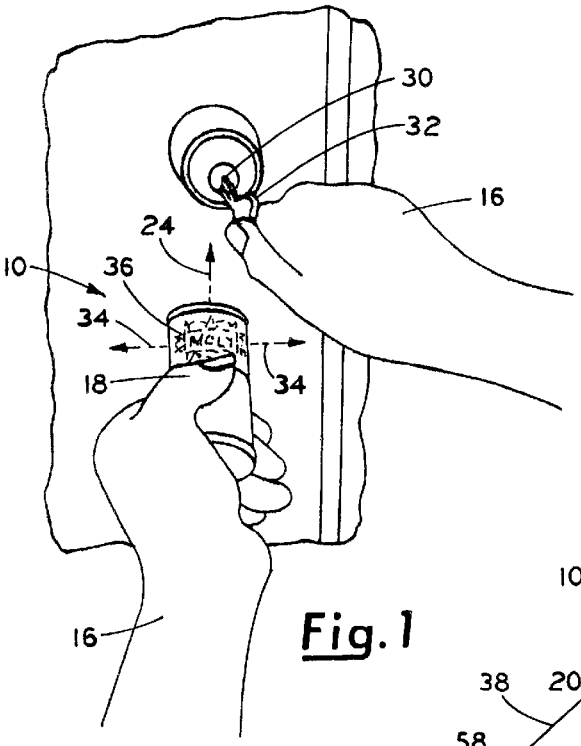
FIG. 1 is a perspective view of the within inventive pocket-sized flashlight in a contemplated end use.
Figure 2:
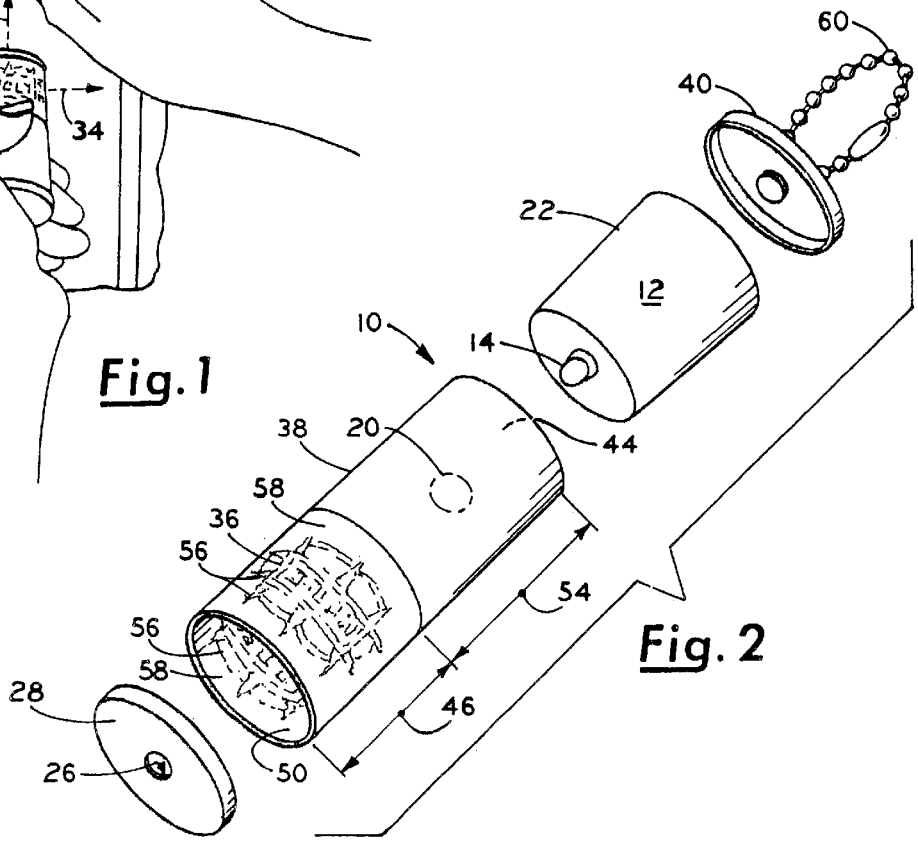
FIG. 2 is an exploded disassembled view of the FIG. 1 flashlight.
Figure 3:
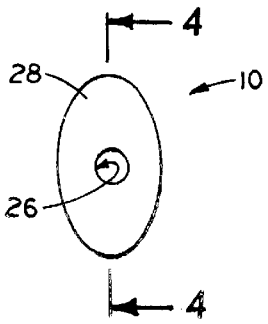
FIG. 3 is a front view thereof.
Figure 4:
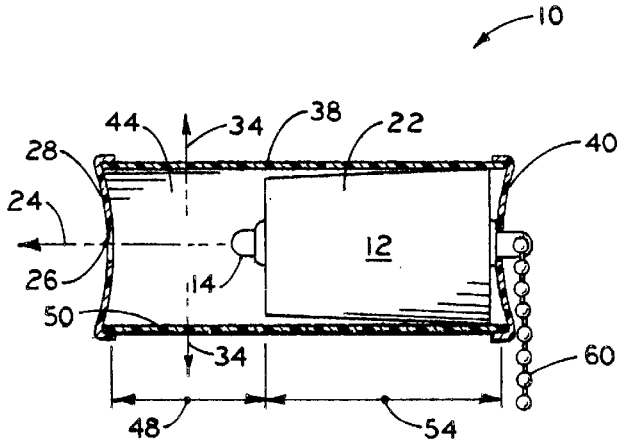
FIG. 4 is a sectional view as taken along line 4—4 of FIG. 3.

A major component of the within inventive flashlight generally designated 10, as will be more fully detailed, is the light-producing means, generally designated 12, in operative electrical connection to a bulb 14 that will be understood to be of identical construction and operating mode to corresponding components of the Compressible Flashlight of U.S. Pat. No. 4,819,140 issued to Griffin on Apr. 4, 1989, said '140 patent by this reference being incorporated herein in its entirety. More particularly, as is made known by the '140 patent, a user 16 pressing down a thumb 18 on an externally noted button location, as at 20, closes contacts which connect batteries within a housing 22 so as to illuminate bulb 14 and produce light 24 emanating forwardly through an opening 26 in a front cover 28 at a proximal end of the flashlight 10. A typical end use, as illustrated in FIG. 1, is to use the light 24 to locate a keyhole 30 preparatory to insertion of a key 32 therein, this typical chore being typically carried out under conditions of reduced visibility, as in the evening or at night, when inter-engagement of the key 32 and keyhole 30 is "hit or miss" without the flashlight-produced light 24.

Underlying the present invention is the recognition that the typical keyhole-locating chore of FIG. 1 is, by its nature, conducted at close range, e.g., within one foot of the user, and that as such, the amount of forwardly-directed light 24 can be of a reduced extent of the total available light to achieve the purposes intended. This phenomena is used to advantage to provide radially-directed light 34 to in turn embody a light display 36 for the flashlight 10 which, in practice, significantly enhances its novelty value, including its distribution as an advertising premium and like article of manufacture.

In a preferred embodiment, the pocket-sized flashlight 10 has a hollow oval shaped housing 38 of flexible plastic construction material with an opposite proximal end for location of the noted front cover 28 and a distal end for location of a bottom closure 40, the oval housing between the ends 28 and 40 being comprised of a correspondingly oval shaped wall 42 which bounds an operative compartment 44.

The noted light-producing means 12 with its battery-operated bulb 14 is appropriately disposed in the compartment 44 adjacent the distal end.

The noted hollow oval sleeve or housing 38 is, it should be noted, of a selected length, such as three inches, such that when disposed in telescoped relation upon and about the housing 22 there is delineated an upper length portion 46 extending, in a preferred embodiment, approximately a distance 48 of one and one quarter inches forward of the bulb 14, so that the extending portion 46 bounds a light compartment 50 in spanning relation between the bulb 14 and the cover exit opening 52.

The construction material of the sleeve 38 has an opaque bottom length portion 54 to mask the presence of the internal housing 22 while the remainder is transparent, except for selected opaque areas, individually and collectively designated 56 imprinted or otherwise applied internally in the surface bounding the light compartment 50.

The transparent areas 58 and opaque areas 56 are appropriately arranged to provide a graphic display 36 in which radially transmitted light 34 from bulb 14 illuminates only the clear areas 58 so as to contrast with the opaque areas 56, all to the end of contributing to the appearance of the flashlight 10 for possible use as an advertising premium article of manufacture, to supplement its limited prior use merely as an attachment to a key chain 60 or other nominal use as an article of individual convenience.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A pocket-sized flashlight for use in diminished visibility for facilitating inserting a key into a keyhole comprising a hollow oval shaped housing with opposite proximal and distal ends and an oval wall extending therebetween bounding an operative compartment, light-producing means disposed in said operative compartment with a battery-operated bulb located adjacent said distal end thereof, a hollow sleeve of a selected length and corresponding oval shape bounding a corresponding oval shaped light compartment disposed in telescoped relation on said housing so as to position said light compartment forwardly beyond said battery-operated bulb for an extent not less than said selected length, selected opaque and transparent areas on a substrate forming a graphic for display disposed in internal encircling relation about said light compartment so that a greater extent of light from said battery-operated bulb illuminates said transparent areas so as to cooperate with said opaque areas to form a display of said graphic, and a cover with a central opening disposed on an open end of said light compartment for transmission through said central opening of a lesser remaining extent of light from said battery-operated bulb, whereby in the light-producing operation of said pocket-sized flashlight there is an illuminated graphic display contributing to the appearance thereof and also at a nominal clearance position from a keyhole illumination of the location thereof.

2. A pocket-sized flashlight for use in diminished visibility for facilitating inserting a key into a keyhole comprising a hollow oval-shaped housing with opposite proximal and distal ends and an oval wall extending therebetween bounding an operative compartment, light-producing means disposed in said operative compartment with a battery-operated bulb located adjacent said distal end thereof, a hollow sleeve of not less than one inch and corresponding oval shape bounding a corresponding oval-shaped light compartment disposed in telescoped relation on said housing so as to position said light compartment forwardly beyond said battery-operated bulb for an extent not less than said one inch, selected opaque and transparent areas on a substrate forming a graphic for display disposed in internal encircling relation about said light compartment so that a greater extent of light from said battery-operated bulb illuminates said transparent areas so as to cooperate with said opaque areas to form a display of said graphic, and a cover with a central opening disposed on an open end of said light compartment for transmission through said central opening of a lesser remaining extent of light from said battery-operated bulb, whereby in the light-producing operation of said pocket-sized flashlight there is an illuminated graphic display contributing to the appearance thereof and also at a nominal clearance position from a keyhole illumination of the location thereof.

* * * * *